United States Patent [19]

Weiss

[11] Patent Number: 4,464,807

[45] Date of Patent: Aug. 14, 1984

[54] FLOOR MOP

[75] Inventor: Roger Weiss, Bagnolet, France

[73] Assignee: Moulinex, Societe Anonyme, Bagnolet, France

[21] Appl. No.: 503,584

[22] Filed: Jun. 13, 1983

[30] Foreign Application Priority Data

Jun. 21, 1982 [FR] France ..... 82 10808

[51] Int. Cl.[3] ..... A47L 13/142

[52] U.S. Cl. ..... 15/119 A; 15/120 A; 15/244 A

[58] Field of Search ..... 15/119 R, 119 A, 120 R, 15/120 A, 244 R, 244 A

[56] References Cited

U.S. PATENT DOCUMENTS 1,724,308 8/1929 Phipps ..... 15/120 A

FOREIGN PATENT DOCUMENTS 211070 2/1924 United Kingdom .

*Primary Examiner*—Edward L. Roberts

*Attorney, Agent, or Firm*—Young & Thompson

[57] ABSTRACT

A domestic floor mop comprises an absorbent band mounted on a bracket carried at the end of a handle. A rotary torsion head is engaged with the band and is rotatably mounted in the bracket. A fastener is fixed to each end of the band, and the fasteners are monted on the bracket for movement between a washing position, in which said fasteners are spaced apart and said band is deployed in a plane, and a wringing position in which said fasteners are closer together such that said band is gathered towards said rotary head to permit twisting of the band upon rotation of said rotary head. The fasteners are each slidably mounted in a respective guide carried by said bracket and extending in a plane parallel to the deployment plane of said band.

14 Claims, 11 Drawing Figures

FLOOR MOP

BACKGROUND TO THE INVENTION

The present invention relates to floor mops.

The floor mop described in British Patent No. 211,070 has an absorbent band which is gathered into a wringing position by the movement of fasteners carried by the band relative to a bracket on which the band is mounted. However, the fasteners are carried at the end of arms pivotably mounted on the bracket, and thus the device is rather fragile.

SUMMARY OF THE INVENTION

It is an object of the invention to provide a floor mop which has a simple and economical construction, and which also overcomes the disadvantage of the known device.

According to the present invention there is provided a floor mop comprising an elongate handle, a bracket carried at one end of the handle, and an absorbent band mounted on the bracket, a bearing arranged on said bracket, and a torsion head rotatably mounted in said bearing, said torsion head engaging the median region of said absorbent band, and two fasteners each fixed to a respective end of said absorbent band and mounted on the bracket for movement between a washing position in which said fasteners are spaced such that said band is deployed in a plane, and a wringing position in which said fasteners are closer together and said band is gathered towards said rotary head to permit twisting of the band upon rotation of said head in the bearing, wherein each of said fasteners is slidably mounted in a respective guide carried by said bracket and extending in a plane parallel to the deployment plane of said band.

The mop of the invention has been found to be extremely robust.

BRIEF DESCRIPTION OF THE DRAWINGS

An embodiment of the present invention will hereinafter be described, by way of example, with reference to the accompanying drawings, in which.

DESCRIPTION OF A PREFERRED EMBODIMENT

Figure 1:
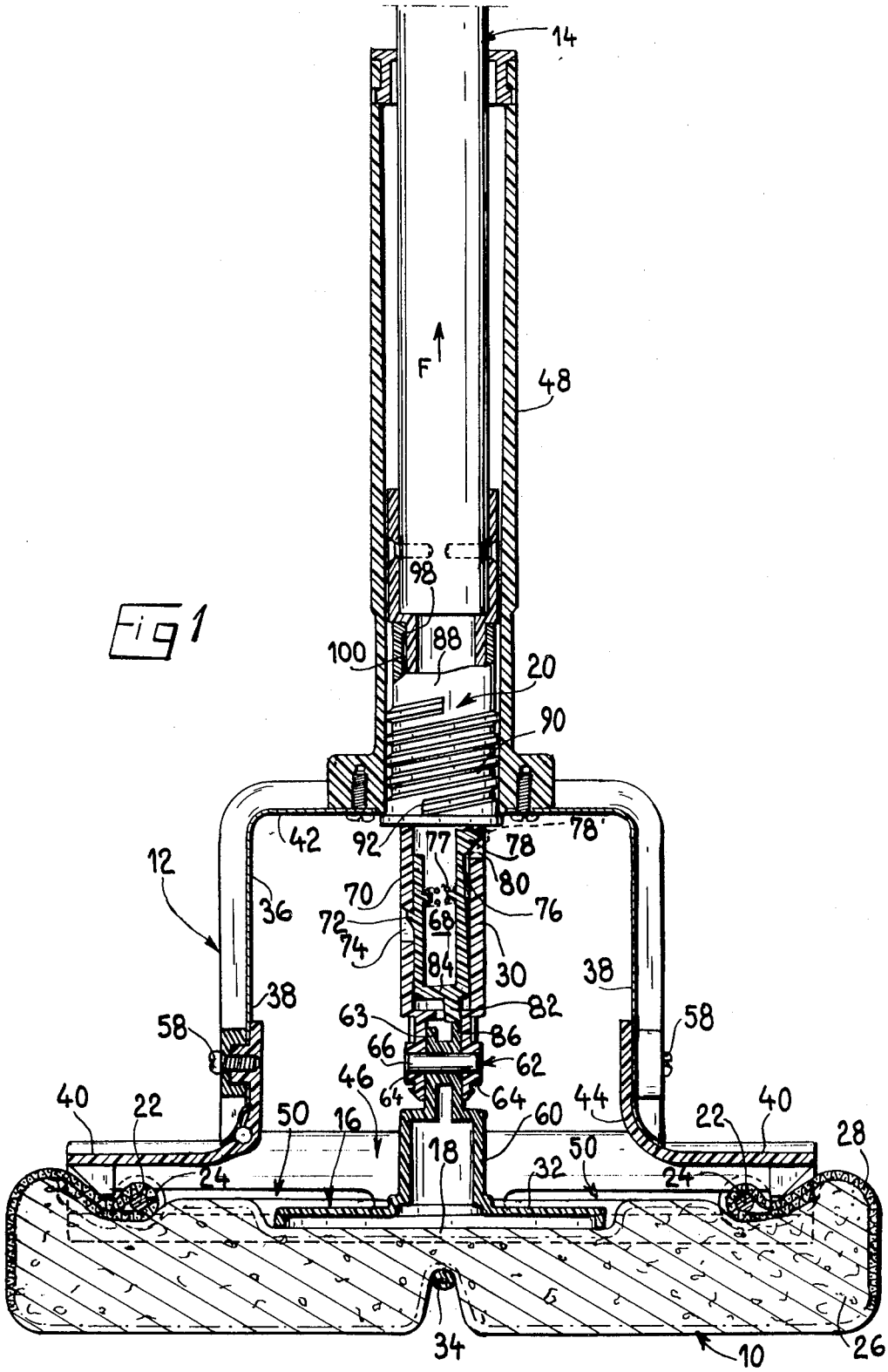
FIG. 1 shows a longitudinal section of a floor mop of the invention showing an absorbent band thereof in its washing position.

The floor mop illustrated in the drawings comprises an absorbent band 10 mounted on a bracket 12 carried at the end of a handle 14. A rotary torsion head 16 is engaged with the median region 18 of the band 10 and is rotatably mounted in a bearing 20 carried on the bracket 12. Two fasteners 22 are fixed to respective ends of the band and are movably mounted on the bracket 12.

The absorbent band 10 consists of a sponge 26 enveloped in a tubular sheath 28 which is made of sacking. The ends 24 of the sheath 28 are folded back on themselves and then stitched together to form two receiving loops for the fasteners 22. The rotary head 16, which is fixed for rotation with the end 30 of the handle 14, comprises a disc 32 which is applied against the median region 18 of the band 10. The band 10 is fixed to the disc 32 by means of a diametral bar 34 which straddles the band.

The bracket 12 comprises a U-shaped stirrup 36, the two arms 38 of which each carry a respective wing 40. The central part 42 of the bracket 12 carries the bearing 20 of the rotary head 16, and so the head is located between the arms 38 of the stirrup. The two wings 40 are formed by the two opposite regions of one integrally moulded elongate plate 44, the central region of which defines a wide aperture 46 receiving the rotary head 16. The handle 14 is slidably mounted in a bush 48 which extends from the central part 42 of the stirrup outwardly of the stirrup and which simultaneously forms part of the bearing 20 for the rotary head 16.

The two fasteners 22 are each slidably mounted on the bracket 12 in a respective one of two guides 50. The fasteners 22 slide between a washing position shown in FIG. 1, in which they are spaced apart such that the band 10 extends in a plane, and a wringing position shown in FIG. 4 in which they are close together such that the band 10 is gathered together close to the rotary head 16, thus permitting the twisting of the band by rotation of the head 16 in the bearing 20.

Figure 2:
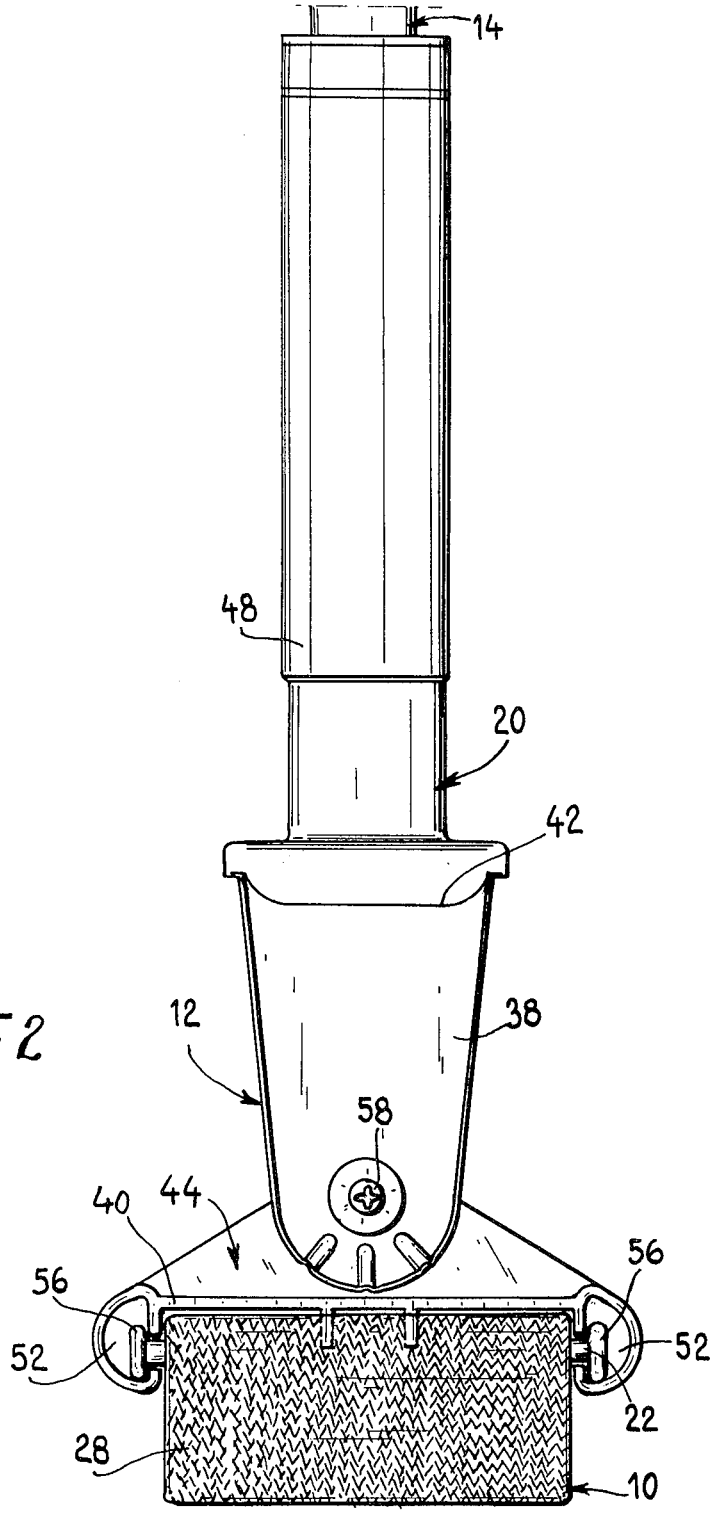
FIG. 2 shows a side elevation of the mop with the band in the same position as in FIG. 1.
Figure 5:
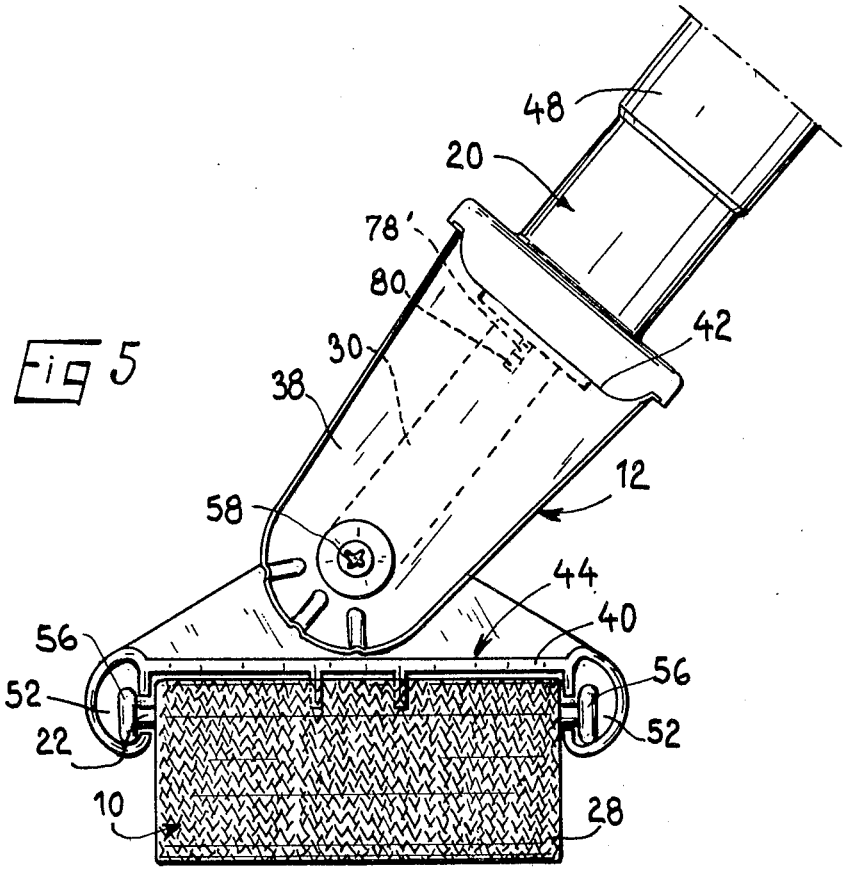
FIG. 5 shows a side elevation of the mop, similar to FIG. 2, but showing the handle in a pivoted position.

Each guide 50 is formed by a pair of rails 52, which are clearly shown in FIGS. 2 and 5, which extend in a plane parallel to the deployment plane of the band 10 and which are carried by the longitudinal edges of the plate 44. Each fastener 22 is formed by a rod threaded into one of the loops 24 and having roller-shaped ends 56 which are slidably mounted in the respective pair of rails 52.

Figure 3:
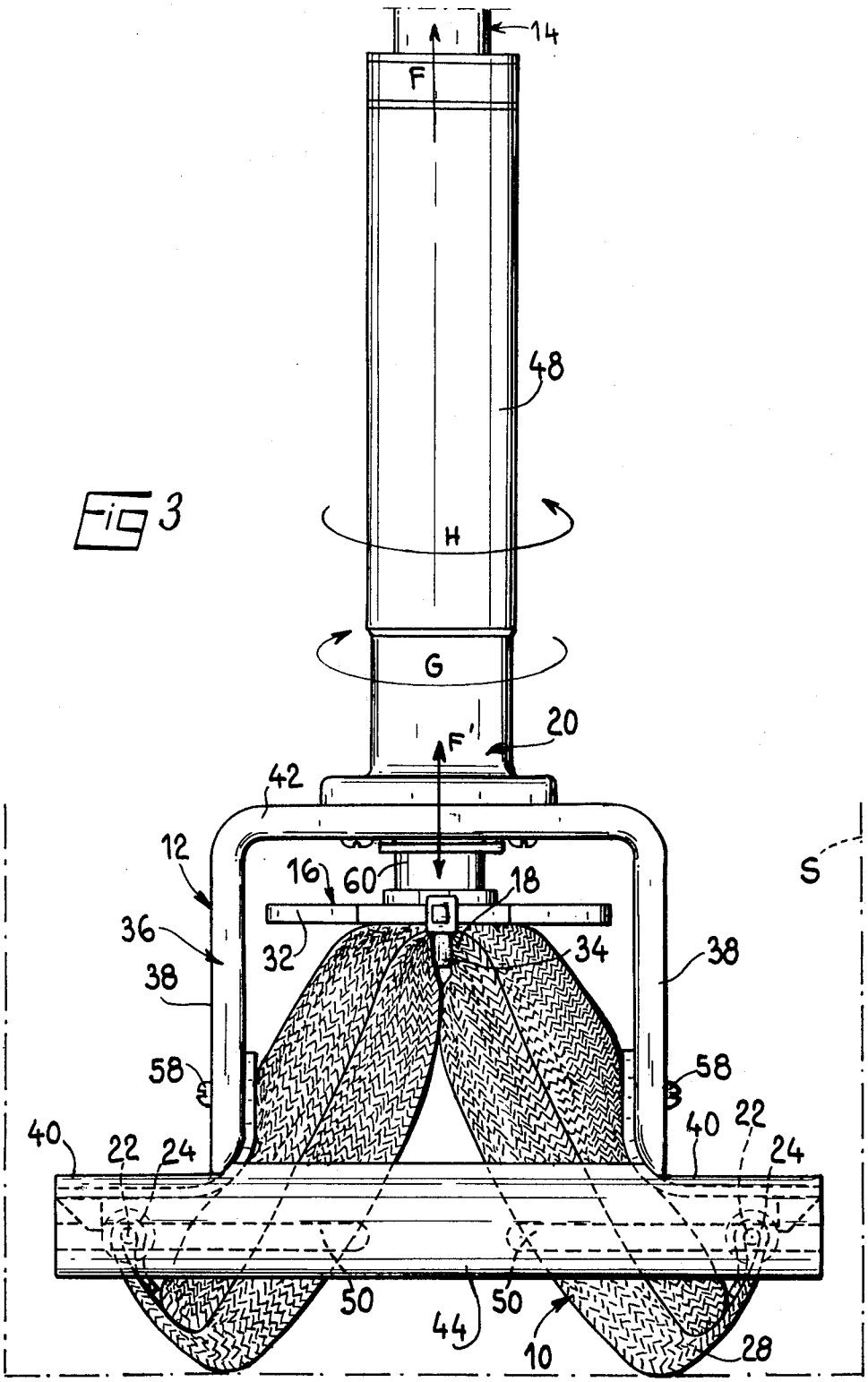
FIG. 3 shows a front elevation of the mop showing the band in a preparatory position for wringing.
Figure 4:
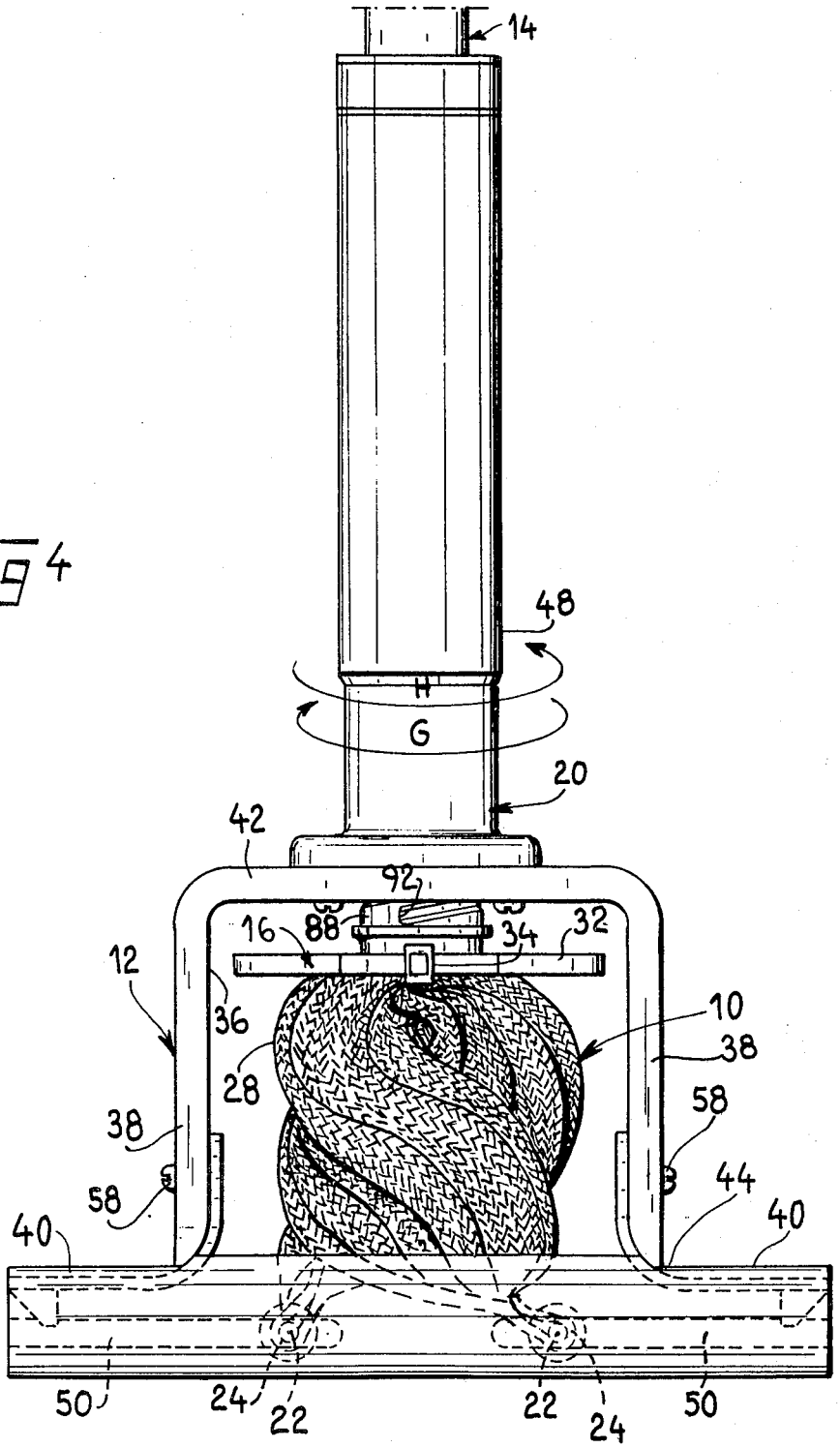
FIG. 4 shows a front elevation of the mop, illustrating the twisting of the band during wringing.

It will be understood that, in order to twist the band 10, it is first of all necessary to slide the handle 14 upwardly in the direction of arrow F in FIG. 1 from a washing position, in which the rotary head 16 is located near to the deployment plane of the band (FIG. 1), to a wringing position, in which the rotary head 16 is located near to the central part 42 of the stirrup 36. The wringing position of the handle 14 is shown in FIG. 3, and it will be seen that in this position the median region 18 of the band 10 is engaged in the interior space of the stirrup. When the handle 14 has been brought to the wringing position, it is rotated in its bearing 20 in the direction of arrow G of FIG. 3. This rotation causes the torsion head 16 to rotate and also causes the fasteners 22 to move towards each other, thereby twisting the band 10 about the axis of the handle as shown in FIG. 4.

In order to enable the user of the mop to wash a floor without undue fatigue, it is possible to incline the handle 14 relative to the deployment plane of the band 10, as illustrated in FIG. 5. In this respect, the plate 44 of the bracket 12, and hence the wings 40 which form part of the plate, are pivotably mounted on the arms 38 of the U-shaped stirrup about a pivot axis extending parallel to the deployment plane of the band and defined by two pivots 58 carried by the arms 38. The disc 32 of the rotary head is carried by a shaft 60 which is connected to the end 30 of the handle 14 by way of a joint 62. The axis of the joint 62 is also parallel to the deployment plane of the band and coincides with the axis defined by the pivots 58 when the handle 14 is in its washing position shown in FIGS. 1, 2 and 5. The joint 62 comprises a tab 63 carried by the end of the shaft 60 and nested between two tabs 64 carried by the end 30 of the handle 14. A pivot 66 extends transverse to these tabs 63 and 64 and defines the axis of the joint 62.

Figure 6:
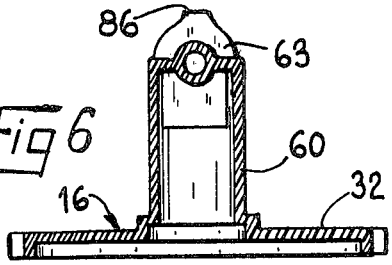
FIG. 6 shows a section of a rotary torsion head of the band.

The mop incorporates a safety device which permits the handle to be axially anchored when the mop is in the pivoted position illustrated in FIG. 5. The end 30 of the handle 14 is hollow, and the interior cavity 68 defined therein contains a U-shaped piece of elastic material having two spaced arms 70 and 76. One arm 70 is held captive in the cavity 68 by a hook 72 carried thereby which engages in a hole 74 in the end 30. The other arm 76 is acted upon by a spring 77 and carries at its end a lateral locking lug 78. This lug 78 is movable between a withdrawn position which is shown in FIG. 1 in which it is retracted inside the end 30 of the handle, and an extended position indicated by dashed lines 78' in FIG. 1, in which it projects from the lateral surface of the end 30 of the handle through a port 80 therein. In its extended position, the lug 78 forms a stop cooperating with the bearing 20 to prevent the handle from sliding upwardly into its wringing position. Control of this lug 78 is effected by a pawl 82 carried by the central part 84 of the U-shaped piece. This pawl 82 is thus movably mounted at the extreme end 30 of the handle and is oriented transversely to the joint axis defined by the pivot 66. The pawl 82 is actuated by a cam 86 arranged on the shaft 60 of the rotary head 16. As shown most clearly in FIGS. 1 and 6, the cam 86 is formed by a localised projection of the edge of the tab 63 carried by the end of the shaft 60. Thus the lug 78 is moved into its withdrawn position (solid lines in FIG. 1) when the axis of the rotary head, defined by the shaft 60, is in alignment with the axis of the handle 14. The lug 78 is moved into its extended position when the rotary head is pivoted relative to the handle 14 such that the axis of the rotary head forms an angle with the axis of the handle 14 as shown in FIG. 5.

Figure 11:
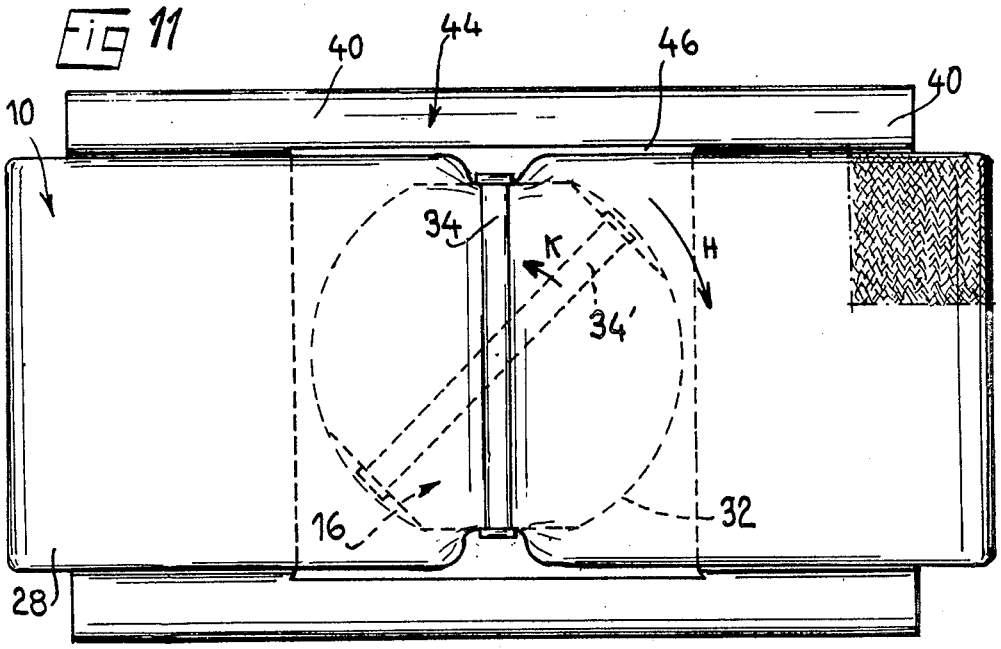
FIG. 11 shows a bottom plan view of the mop, with the band in the position illustrated in FIGS. 1 and 2.
Figure 8:
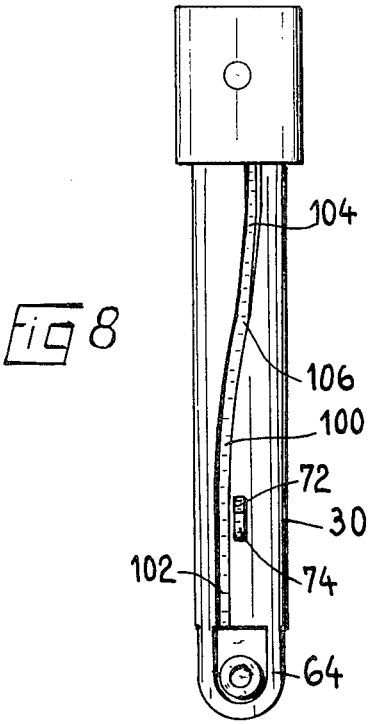
FIG. 8 shows an end elevation of the handle.
Figure 9:
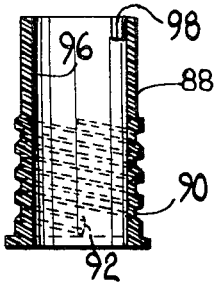
FIG. 9 shows a section of a tubular sleeve which forms part of the rotation limiting device and which receives the end of the handle illustrated in FIG. 8.
Figure 10:
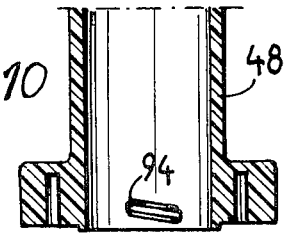
FIG. 10 shows a vertical section of a bush which receives the sleeve illustrated in FIG. 9.
Figure 7:
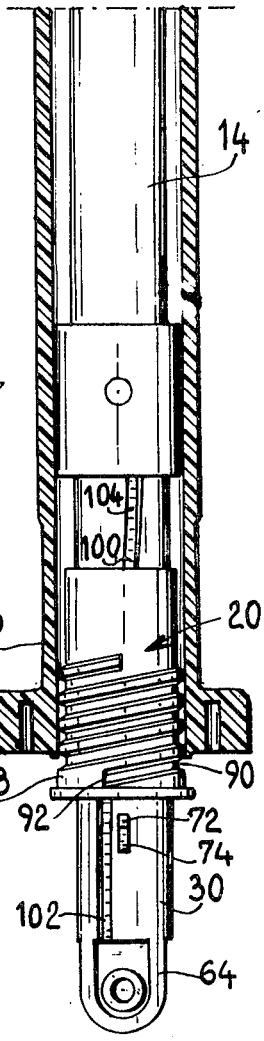
FIG. 7 shows a section of a limiting device for the rotation of the rotary head.

It will be appreciated that in order to obtain sufficient twisting of the band 10 to provide effective wringing, it is necessary to rotate the rotary head 16 in the direction of arrow G through several turns from the initial angular position illustrated in FIGS. 1, 2 and 11. This makes it difficult for the user to unwind the band by the inverse rotation of the head 16 in the direction of arrow H such that the head 16 is returned to its initial angular position.

Accordingly, an inverse rotation limiting device is incorporated in the bearing 20 to effect automatic return of the head 16 to its initial angular position. The rotation limiting device can be seen in FIGS. 1 and 7 to 11, and comprises a tubular sleeve 88 engaged in the bush 48. A helicoidal screwthreaded groove 90 is formed on the exterior wall of the sleeve 88 and is limited by stop 92. The sleeve 88 is screwed into the bush 48 and the interior surface of this bush carries a rib 94 which engages in the screwthreaded groove 90. The interior wall 96 of the sleeve 88 forms a sliding and guiding surface for the handle 14 and is also arranged to rotationally fix the handle 14 and the sleeve 88. In this respect, the wall 96 carries a nipple 98 which is engaged in a longitudinal channel 100 formed in the lateral surface of the end 30 of the handle. Thus rotation of the handle 14 causes, by cooperation of the channel 100 with the nipple 98, a corresponding rotation of the sleeve 88 on the screwthread 94. This rotation is limited when the stop 92 of the screwthreaded groove 90 comes into contact with the rib 94 of the bush when rotation is effected in the unwinding direction of the band (arrow H), that is, in the direction which screws the sleeve 88 into the bush 48.

If, at the end of this inverse rotation, the rotary head 16 were to be returned exactly into its initial angular position (which is illustrated in FIG. 3), the band 10 would not in reality be completely unwound because of the inertia of the material forming the band. For this reason it is preferable for the inverse rotation to overrun slightly (for example by one eighth of a turn, that is, 45°) the angular position illustrated in FIG. 3, until a limit inverse rotation position is reached. The limit inverse rotation position is shown in FIG. 11, and in this position the diametral fixing bar 34 takes up the limit overrun position indicated by the reference 34'.

Obviously, before continuing to use the mop for washing, the rotary head 16 should be returned to its normal washing position, that is, the rotary head 16 should be rotated slightly backwards in the direction of arrow K until the bar 34 reaches the position illustrated by solid lines in FIG. 11.

The rotary head 16 is returned automatically to its correct position. In this respect, the longitudinal channel 100 is formed to have two axially spaced rectilinear parts 102 and 104, which extend respectively along two generatrices angularly staggered at approximately 45°, and which are mutually connected by a helicoidal median part 106 of elongate pitch. When the handle 14 is in its upward wringing position (FIGS. 3 and 4), the lower rectilinear part 102 causes the sleeve 88 to be driven in rotation both during the twisting (FIG. 4) and during the unwinding of the band. The angular positioning of this lower part 102 is such that during unwinding of the band, the inverse rotation is stopped at the angular position of the head 16 illustrated at 34' in FIG. 11. During the subsequent sliding of the handle 14 back into its washing position (FIG. 1), the nipple 98 of the sleeve 88 cooperates with the upper part 104 of the channel 100 to compel the handle 14 to correct its position (arrow K) by an angle equal to the angular stagger of 45° between the parts 102 and 104 of this channel. Thus, the handle finally reaches an angular position corresponding exactly to the initial position of the rotary head 16 (bar 34 in solid lines in FIG. 11).

For clarity, the operation of the above-described mechanisms during use of the mop will be reconsidered.

The mop is assumed initially to occupy the position of FIGS. 1 and 2. Thus, the user first of all inclines the handle 14 to move it into its pivoted position illustrated in FIG. 5. During this movement, the cam 86 releases the pawl 82 and the lug 78 is moved into its extended position 78'. After passing the mop over the floor to be washed, the user returns the handle 14 into its straight position of FIG. 1, which, by the action of the cam 86 upon the pawl 82, causes the retraction of the lug 78. The user can then pull the handle upwardly (arrow F)

to move it into its wringing position (FIG. 3). If the mop is then put into a pail of water (indicated at S in FIG. 3) the exertion of reciprocating vertical sliding movements (arrows F') upon the handle 14 will effect correct rinsing of the band 10 by serially contracting and expanding the band into and out of the interior space of the stirrup 36.

The user then returns the handle to its top position of FIG. 3 to enable rotation of the handle 14 (arrow G) and twisting of the band 10 to effect wringing thereof. During wringing, the fasteners 22 move towards one another (FIG. 4). The sleeve 88 is rotated by the action of the lower part 102 of the channel 100 upon the nipple 98, and is thus removed from the bush 48 by the unscrewing effect of the screwthreaded groove 90.

Once the wringing has been completed the user turns the handle 14 in the opposite direction (arrow H), and the sleeve 88 screws in the bush 48 until the stop 92 of the groove 90 meets the rib 94. The rotary head 16 then stops in the position designated 34' in FIG. 11 with the band 10 completely unwound and the handle 14 still in its top wringing position.

Then, in order to return the band 10 into its deployment position as in FIG. 1, the user lowers the handle 14 ( opposite direction to the arrow F). During this movement, the fasteners 22 separate under the thrust exerted upon them by the band 10, and the rotary head 16 is rotated back by one eighth of a turn (arrow K) by the cooperation of the nipple 98 with the channel 100.

It is then only necessary to pivot the handle 14 again (FIG. 5) to place the mop in a suitable position for passing again over the floor to be washed.

I claim:

1. A floor mop comprising an elongate handle, a bracket carried at one end of the handle, and an absorbent band mounted on the bracket, a bearing arranged on said bracket, and a torsion head rotatably mounted in said bearing, said torsion head engaging the median region of said absorbent band, and two fasteners each fixed to a respective end of said absorbent band and mounted on the bracket for movement between a washing position in which said fasteners are spaced such that said band is deployed in a plane, and a wringing position in which said fasteners are closer together and said band is gathered towards said rotary head to permit twisting of the band upon rotation of said head in the bearing, wherein each of said fasteners is slidably mounted in a respective guide carried by said bracket and extending in a plane parallel to the deployment plane of said band.

2. A mop according to claim 1, wherein the bracket comprises a U-shaped stirrup having two arms and a central part, the two arms of the stirrup each carrying a respective wing, the wings supporting said guides, and the central part of the stirrup carrying the bearing of the rotary head such that said head is located between the arms of the stirrup.

3. A mop according to claim 2, wherein said two wings are formed by the two opposite regions of one elongate plate, the central region of said plate having a wide aperture for reciving the rotary head.

4. A mop according to claim 3, wherein each said guide is formed by a pair of rails carried by longitudinal edges of said plate, and each said fastener is formed by a rod, the ends of each rod being slidably mounted in the rails of said pair.

5. A mop according to claim 4, wherein each end of said band is folded over to form a receiving loop for the respective rod.

6. A mop according to claim 2, wherein the rotary head is rotationally fixed to said one end of the handle, and further comprising a bush extending from the central part of the stirrup outwardly of the stirrup, said bush receiving said handle and also forming part of the bearing of the rotary head.

7. A mop according to claim 6, wherein the handle is slidably mounted in the bush between the washing position, in which the rotary head is located near to the deployment plane of the band, and a wringing position, in which the rotary head is located near to the central part of the stirrup and the median region of the band is within the interior space of the stirrup.

8. A mop according to claim 7, wherein the wings of the bracket are each pivotably mounted on the arms of the stirrup about a pivot axis extending parallel to the deployment plane of the band, and wherein the rotary head is connected to said end of the handle by a joint, the axis of said joint extending parallel to the deployment plane of the band and coinciding with said pivot axis of the wings when the handle is in its washing position.

9. A mop according to claim 8, wherein the rotary head comprises a disc which is applied against the median region of the band, and further comprising a dimetral bar which straddles the band and fixes the band to said disc, and wherein said disc is carried by a shaft which is connected to the end of the handle by way of said joint.

10. A mop according to claim 8, wherein the end of the handle carries a lateral locking lug which is movable between a withdrawn position, in which it is retracted within the handle, and an extended position, in which it projects from the lateral surface of the handle and forms a stop cooperating with the bearing to prevent said handle from sliding into its wringing position, ad further comprising a pawl mounted movably on the handle and actuated by a cam arranged on the rotary head, said pawl controlling the lug such that the lug is moved into its withdrawn position when the axis of the rotary head is aligned with the axis of the handle and that the lug is moved into its extended position when the rotary head is in a pivoted position relative to the handle and its axis forms an angle with the axis of the handle.

11. A mop according to claim 10, wherein the joint between the end of the shaft of the rotary head and the end of the handle comprises at least one tab carried by one of these ends and nested between two tabs carried by the other end, and a pivot extending transverse to said tabs and defining the joint axis, and wherein the cam is formed by a localised projection of the edge of one of said tabs carried by the end of the shaft of the rotary head, and the movable pawl is carried at the end of the handle and oriented transversely to said joint axis.

12. A mop according to claim 11, wherein the end of the handle is hollow, the pawl is carried by the central part of a U-shaped piece of elastic material which is arranged in the interior cavity of the end of the handle, and one arm said piece of elastic material is captive in said cavity and the other arm thereof carries the lug at its end.

13. A mop according to claim 7, wherein sufficient twisting of the band to cause correct wringing is obtained by rotating the rotary head through several turns from an initial angular position, and wherein the bearing includes a rotation limiting device which, upon inverse rotation of the head to unwind the band, returns the rotary head to a position near to said initial angular position, said limiting device comprising a tubular sleeve which is engaged in said bush, a screwthreaded groove on the exterior wall of said sleeve limited by a stop, the sleeve being screwed into said bush in which a complementary rib is mounted, the interior wall of said sleeve being arranged to rotationally fix the sleeve to the handle and forming a sliding and guiding surface for said handle, said interior wall carrying a nipple engaged in a longitudinal channel made in the lateral surface of the end of the handle, rotation of the handle being arranged to cause, by cooperation of the channel with the nipple, a corresponding rotation of the sleeve on the screwthread, the rotation of the sleeve being limited by the stop when said stop abuts said rib.

14. A mop according to claim 13, wherein the longitudinal channel comprises two axially spaced rectilinear parts which extend respectively along two angularly staggered generatrices and which are mutually connected by a helicoidal median part of elongate pitch, the lower rectilinear part causing, when the handle is in the wringing position, the sleeve to be rotated during both the twisting and the unwinding of the band, and the angular position of said lower part being such that, during unwinding the inverse rotation is limited at an angular position of the rotary head beyond the initial position such that the band is completely unwound despite the inertia of the material forming the band, whereas when the handle is slid back into its washing position, the nipple of the sleeve, cooperating with the channel, compels the handle to correct its position by an angle equal to the angular stagger between said rectilinear parts so that said handle is returned to an angular position which corresponds exactly to the initial position of the rotary head.

* * * * *